United States Patent [19]

Profet

[11] 4,015,824

[45] Apr. 5, 1977

[54] JACK SAFETY STOP

[75] Inventor: Anthony G. Profet, Wheeling, Ill.

[73] Assignee: Templeton, Kenly & Company, Broadview, Ill.

[22] Filed: Apr. 5, 1976

[21] Appl. No.: 673,390

[52] U.S. Cl. ..... 254/89 R; 74/89.15; 74/424.8 R; 254/98; 254/103

[51] Int. Cl.[2] ..... B66F 3/18

[58] Field of Search ..... 254/89 R, 98, 103, 1; 74/424.8 R, 89.15, 524, 543; 192/141

[56] References Cited

UNITED STATES PATENTS

| | | | |
|---|---|---|---|
| 2,655,223 | 10/1953 | Villars | 254/89 |
| 3,221,118 | 11/1965 | Hoover | 192/141 |
| 3,707,885 | 1/1973 | Profet | 74/543 |

*Primary Examiner*—Al Lawrence Smith
*Assistant Examiner*—Robert C. Watson
*Attorney, Agent, or Firm*—Neuman, Williams, Anderson & Olson

[57] ABSTRACT

A gear axially drives a jack support element and is adapted to reciprocally move the same along a movement axis. A stop disposed adjacent an end limit of the element movement is adapted to collapse upon exertion of a predetermined force thereagainst whereby damage to the driving gear and driven support element is avoided.

14 Claims, 11 Drawing Figures

JACK SAFETY STOP

This invention pertains to a supporting jack construction, and more particularly relates to jack constructions in which damage resulting from overload is obviated by means of novel stops adapted to fail under a predetermined applied force.

In the jack embodiments hereinafter described in detail, axially movable, object-supporting worm or screw shafts or axially movable object-supporting traveling nuts engaging rotatable worm or screw shafts engage stops at the ends of their movements. The stops are adapted to fail under predetermined loads thereby preventing damage to driving jack components such as worm gears, worm gear nuts, load screws and supporting bearings as will hereinafter be explained in greater detail. In a specific jack application a novel jacking gland and stop arrangement is employed to prevent penetration of abrasive atmosphere into engagement with interengaging jack surfaces as will also hereinafter be explained in greater detail.

The prior art has employed safety connections of various types adapted to flex or fracture upon exertion of an excessive force not usually encountered, to either maintain a desired structural assembly or prevent damage to adjacent structural components to be protected.

Thus Elias U.S. Pat. No. 3,920,220, granted Nov. 18, 1975 discloses a jack post construction which includes a compression spring for purposes of properly seating opposite post foot portions and allowing "give" resulting from temperature occasioned expansion and contraction.

Johnsen U.S. Pat. No. 2,048,388 granted July 21, 1936 discloses a safety device comprising a breakable hose connection to prevent damage to a pump construction. Treese U.S. Pat. No. 3,387,863, granted June 11, 1968 relates to a string of tubing disposed in a well bore having a safety joint of reduced thickness adapted to "give" or fracture upon exertion of a predetermined tensile force on the tubing string and joint.

There, however, is nowhere disclosed in the prior art a structural fixture adapted to deform upon exertion of a predetermined force thereon so as to prevent damage to a mechanical motive means such as a screw jack as will hereinafter be described in detail.

In accordance with a particular embodiment of the provided invention a reciprocally movable anode support screw is disposed within a protective housing from which the screw extends through a sealed opening.

Although the prior art discloses the use of electrical conductors mounted on supports extending through sealed openings as in Hass et al U.S. Pat. No. 3,037,928, granted June 5, 1962, Conger et al U.S. Pat. No. 3,152,057, granted Oct. 6, 1964 and Jacobs U.S. Pat. No. 3,838,384, granted Sept. 24, 1974, there is nowhere disclosed in the prior art the novel seal construction hereinafter described in detail in which an adjustable stop provides a packing gland support.

It is an object of this invention, therefore, to provide a "fail safe" jack construction in which an adjustable stop member is designed to yieldably give relative to a moving jack component so as to avoid damage to expensive motivating jack elements and related components.

It is another object of this invention to provide jack systems which are economical to operate inasmuch as a single motive means is employed for actuating a plurality of jack members simultaneously.

It is a further object of this invention to provide jack constructions employing safety stop means whereby a plurality of jacks operable in unison may be driven by a single motive means so as to reach end limits of their permissible movement without the danger of damaging any single jack construction as a result of overload.

It is still another object of this invention to provide a jack construction in which a reciprocally movable load screw extends through a sealed opening, such opening being protected by means of a novel gland and adjustable stop combination which prevents entry of the ambient atmosphere into a protective casing from which the movable jack screw extends.

The above and other objects of this invention will become apparent from the following detailed description when read in the light of the accompanying drawings and appended claims.

In one embodiment of this invention a worm gear drive rotatably engages a worm gear nut, the latter also engaging a threaded load screw which is reciprocally moved by rotation of the driven nut maintained in a jack housing. The driven screw moves axially through a sealed opening of a protective tubular casing member, the lower end limit of which is externally threaded for purposes of engaging an adjustable stop member which may be threadably positioned into a desired stop position thereon.

Attached to the end of the screw which extends through the sealed opening is a supported member adapted to be desirably positioned by the load screw. The supported member may move in parallel guides which prevent screw rotation whereby the rotational movement imparted to the worm gear nut engaging the load screw and also engaging a input threaded worm may be translated into reciprocal movement of the load screw along the axis thereof. The load screw will have a direction of movement determined by the direction of rotation of the worm gear nut driving the same.

Upon retracting the load screw into its protective casing an enlarged end portion of the screw may engage the adjustable stop disposed at the lower end of the casing and be urged thereagainst, if the driving worm gear engaging the screw is not deactivated at the proper instant. Accordingly, to prevent damage to the driving worm gear nut, engaged load screw, driving worm engaging the worm gear nut as well as bearing members for the foregoing components, the protective casing member through which the load screw extends has a peripheral segment of reduced thickness disposed adjacent the adjustable stop. The segment deforms upon exertion of a predetermined force against the lower end limit of the adjustable stop of the casing thereby preventing damage to the various jack components until the drive worm gear nut is deactivated.

The foregoing jack construction is adapted to be employed in a number of applications in which support jacks are employed and the actuating means thereof driven by a motive means. Accordingly, if the load screws of a plurality of jacks driven by a single motive means do not engage their adjustable stops at precisely the same instant, the collapsible safety segments embodied in each of the load screw protective casings will enable the casings to give or buckle to the extent necessary to enable all of the jack members to engage their adjustable stops with the single motive means deactuated without damage being imparted to any single jack mechanism.

Such jack systems may be employed in applications such as the refining of aluminum wherein a plurality of anode members are moved in unison, as well as in underwater support constructions such as may be employed for purposes of supporting an off-shore drilling platform. Thus, the invention hereinafter described in greater detail may be employed in a number of applications in which a plurality of jacks driven by a single motivating means are designed to arrive at the end limits of their movement at precisely the same instant.

For a more complete understanding of this invention reference will now be made to the drawings wherein FIG. 1 is a fragmentary top plan view illustrating a plurality of support jacks which are driven by a single motive means through interconnecting coupling members;

Figure 1:
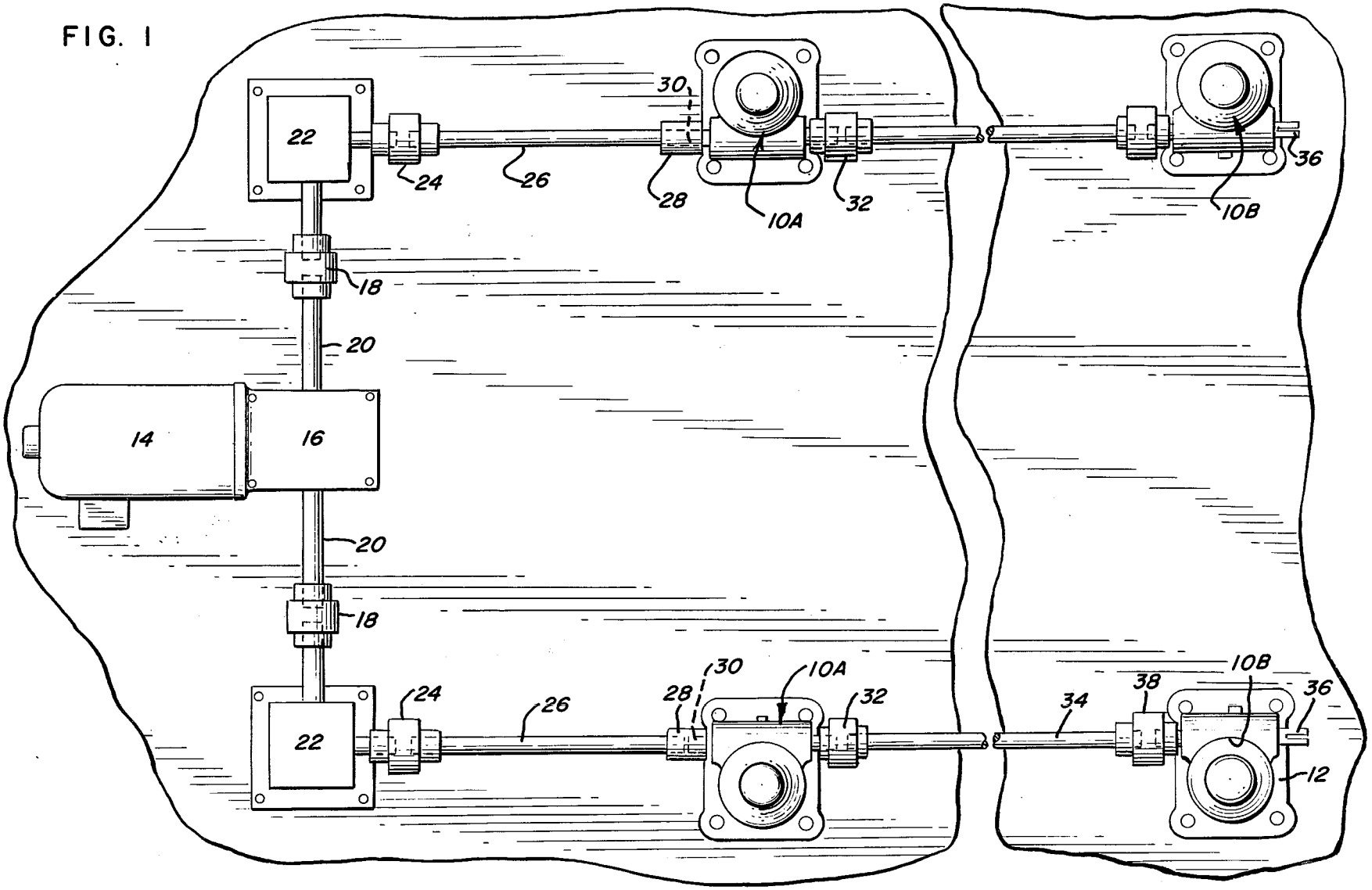

Referring to FIG. 1 a top plan view of a jack system which by way of example may comprise four worm gear screw jacks 10A and 10B such as are manufactured by Templeton, Kenly & Company of Broadview, Ill. and sold under the trademark SIMPLEX. Each of the jacks 10 may be mounted on a pad (not illustrated) resting on a support surface. Such pads may provide electrical insulation for the jacks in the application hereinafter described. The illustrated system of four jacks 10 is actuated by means of a single drive motor 14 connected to a speed reducer 16 which by means of couplings 18 and connecting shafts 20 imparts the rotational drive of the motor 14 to the opposed gear boxes 22. The latter gear boxes in turn transmit the rotary movement received from the connecting shafts 20 to the adjacent jack members 10A by means of the couplings 24 and connecting shafts 26.

The shafts 26 are connected by means of sleeve couplings 28 to input drive shafts 30 of each jack 10A. The input worm shaft 30 of each jack 10A is also connected at the ends opposed to the sleeve couplings 28 to couplings 32 which also engage connecting shafts 34 for purposes of rotating input shafts 36 of each jack 10B, the connecting shafts 34 being connected to the shafts 36 by means of couplings 38. Although FIG. 1 depicts an assembly of four jacks motivated by a single motor 14, it is apparent that additional jacks may be connected to series to jacks 10B for purposes of being simultaneously driven by the motive means 14. The only limitation upon the number of driven jacks is the capacity of the motive means relative to the rotary force needed to actuate the driven jack members.

Figure 2:
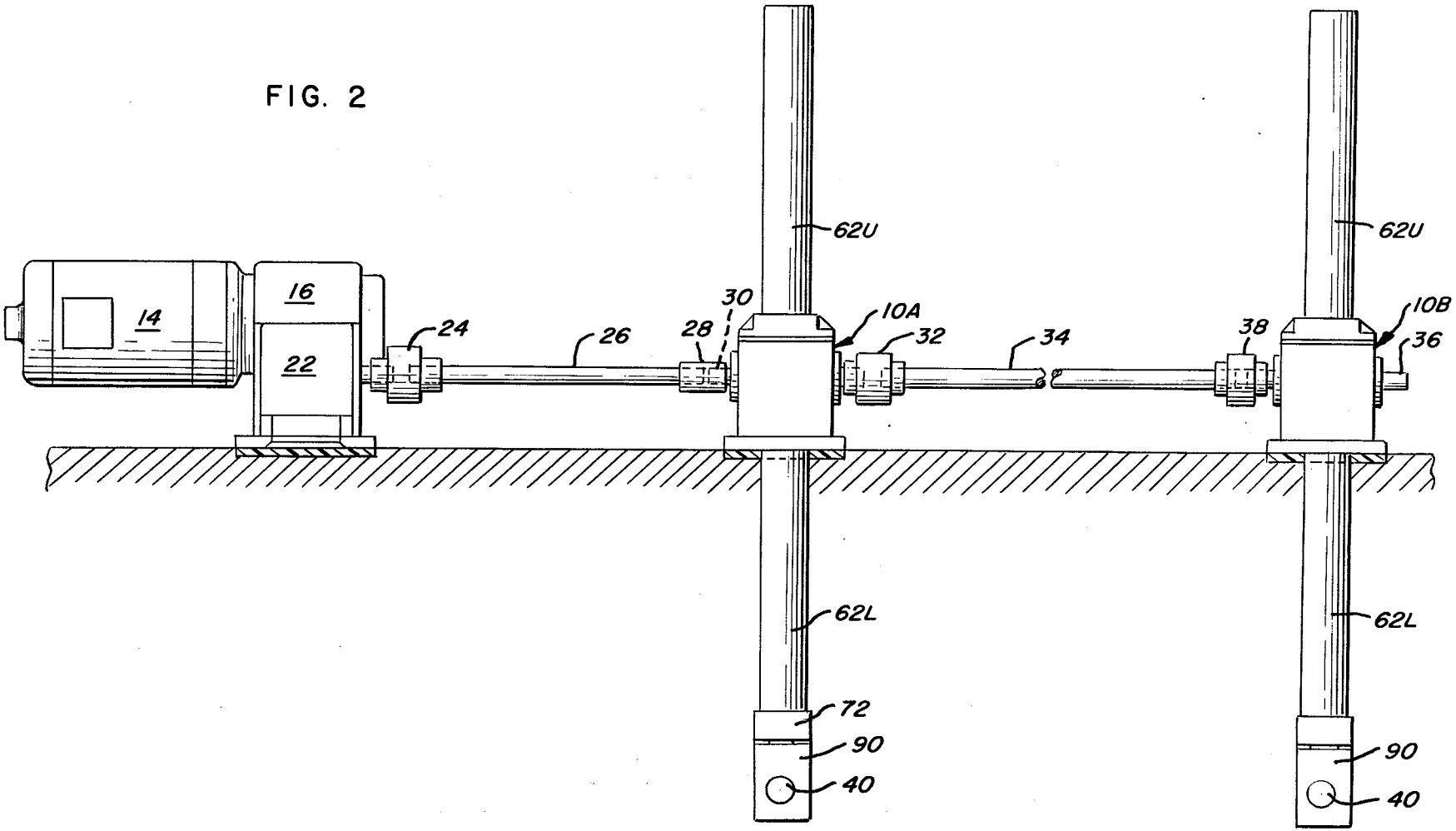
FIG. 2 is a front elevational view of the apparatus of FIG. 1.
Figure 4:
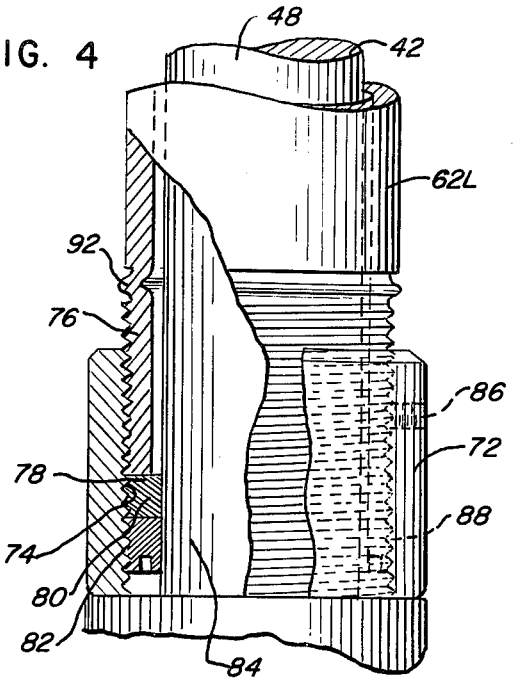
FIG. 4 is an enlarged fragmentary elevational view partly broken away and partly in section illustrating the appearance of a safety feature built into the tubular casing of the jack of FIG. 3 after a predetermined axial force has been exerted against the end of such casing.
Figure 5:
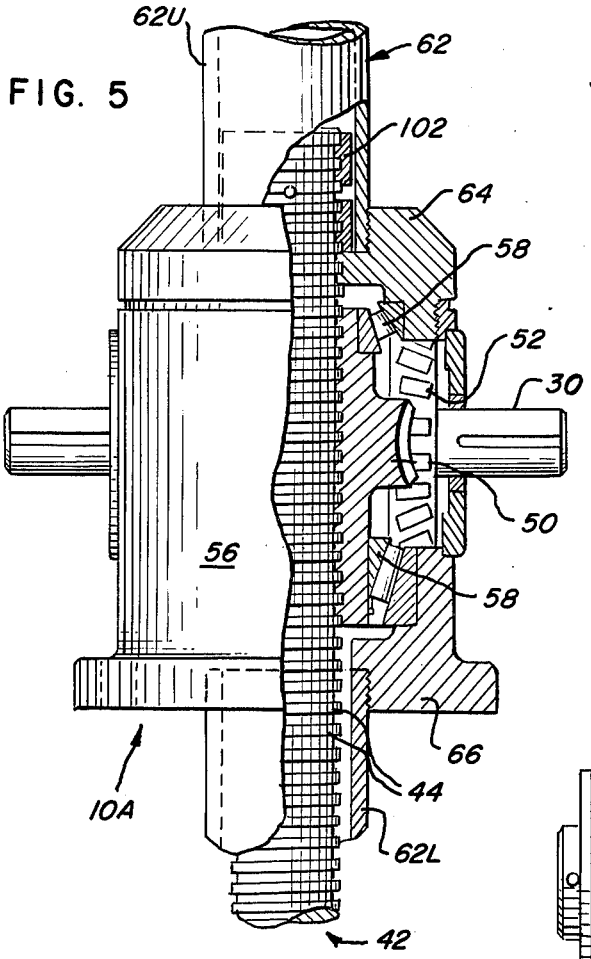
FIG. 5 is a fragmentary elevational view partly in section and partly broken away illustrating the load screw of the jacks of FIGS. 1 through 4 in its fully extended position with a stop member in the seated position preventing further extension of the load screw.
Figure 3:
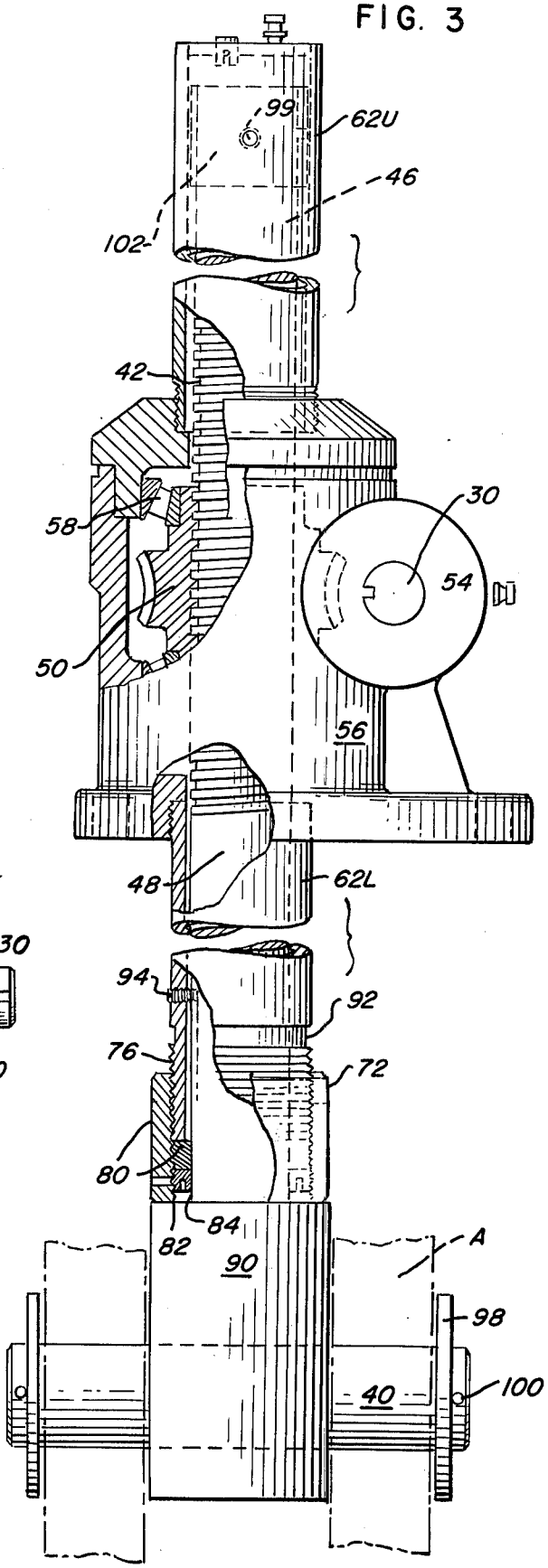
FIG. 3 is a fragmentary side elevation view partly broken away and partly in section of one of the jack constructions and associated parts illustrated in FIGS. 1 and 2.

FIG. 2 illustrates anode support pin 40 connected to enlarged distal ends 90 of load screws 42 which are not shown in FIG. 2 but illustrated in FIGS. 3 through 5. It will be noted from the latter figures that each load screw 42 has formed in a central section thereof threads 44, the latter central section being integral with an upper unthreaded screw section 46 and a lower unthreaded screw section 48 (see FIG. 3).

In accordance with the normal operation of each jack 10A and 10B, screw 42 is actuated and reciprocally movable in the vertical plane by means of worm gear nuts 50 illustrated in FIGS. 3 and 5, the latter figures depicting a jack member 10A. The worm gear nut 50 is in turn driven by the input shaft 30 above described, and receives its rotary movement from the motor 14 by means of the interconnecting speed reducer 16, connecting shaft 20, coupling 18, gear box 22, coupling 24, connecting shaft 26 and coupling 28. Input shaft 30 is integral with a threaded worm portion engaging the worm gear nut 50 and is rotatably mounted in bearings 52. Bearings 52 are disposed in housing 54 connected to worm gear nut housing 56 in the manner most clearly seen in FIG. 3. Worm gear nut 50 is rotatably mounted in jack housing 56 on roller bearings 58.

It will be seen from FIGS. 1 through 5 that screw 42 is reciprocally movable within upper and lower tubular casing sections 62U and 62L ends of which threadably engage upper portion 64 and lower portion 66 of jack casing 56 in the manner most clearly seen in FIGS. 3 and 5. The portions 62U and 62L of the tubular casing 62 are adapted to form protective coverings for the load screw 42 and particularly for the threads 44 thereof.

In the illustrated jack assembly of FIGS. 1 and 2, the jacks 10A and 10B are illustrated in an arrangement, which may be employed by way of example, in the electrolytic recovery of aluminum metal. The ambient atmosphere encountered in such a jack application is normally filled with abrasive dust particles which upon coming in contact the jack elements disposed within the casing 62 and jack housing 56, result in damage to finely machined surfaces of the load screw 42, worm gear nut 50, worm gear portion of the drive shaft 30 as well as the supporting bearing components 52 and 58.

Figure 11:
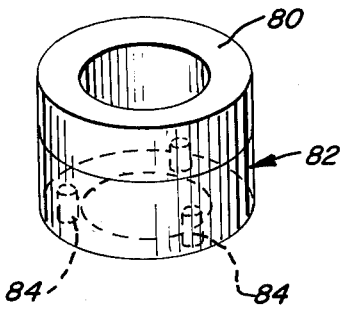
FIG. 11 is a perspective view of a packing ring and gland member which may be employed with the jack constructions of FIGS. 1 through 5.

Accordingly, to prevent entry of such abrasive atmosphere into the jack interior the lower, smooth unthreaded portion 48 of the load screw 42 projects through a sealed opening disposed at the lower end portion of the tubular casing portion 62L. It will be noted from FIGS. 3 and 4 that the lower end portion of tubular casing 62 is threaded at 76 for purposes of engaging an adjustable stop collar 72, interior threads 74 thereof engaging the exterior threads 76 of the tubular casing 62. Urged against lower end limit 78 of tubular casing 62 is a ring of packing (80) see FIG. 11) which is urged into tight abutting relationship against the lower end limit 78 of the casing member 62 and simultaneously into tight, slidable engagement with the outer lower periphery of the unthreaded portion 48 of the load screw 42 by means of packing gland 82 (see FIG. 11) which is externally threaded to engage threads 74 of stop collar 72. Apertures 84 in gland 82 are adapted to receive a spanner wrench for desired positioning against the packing 80. Screws 86 (FIG. 4) disposed in threaded collar apertures are adapted to engage threaded portion 76 of the casing portion 62L for collar positioning purposes, and screws 88 are similarly mounted in threaded collar apertures to position the packing gland 82 in place after desired positioning thereof. Thus in normal course of being extended and retracted into the tubular casing 62, the load screw 42 extends through a sealed opening defined in part by packing 80 which prevents entry of any abrasive dust or other undesired material into the interior of the jack members 10A and 10B. Thus a substantially air tight jack construction is provided which is not affected by abrasive particles in the ambient atmosphere.

The jack assemblies illustrated in FIGS. 1 and 2 are representative of one application of the provided invention in which a plurality of jacks actuated by a single motive means comprising motor 14 are raised and lowered simultaneously. The jack system illustrated may be employed in the electrolytic recovery of aluminum metal in which the load screws 42 of the jack constructions 10A and 10B support and position carbon anodes such as anode A fragmentarily illustrated in phantom lines in FIG. 3, by means of their support pins 40, predetermined distances relative to underlying cathodes. The jacks 10A and 10B extend the load screws 42 until the support pins 40 and anodes supported thereon are at predetermined distances relative to the underlying cathodes and bath. Such distances are regulated to provide a desired anode-cathode voltage. Eventually in the course of the electrolytic metal recovery process the anodes are eaten away to a degree where they must be replaced. As a consequence of the anode consumption, the anodes must be replaced at substantially regular intervals.

In the normal course of anode replacement an attendant will energize motor 14 so as to simultaneously raise the load screws 42 disposed in each of the tubular casings 62 by rotating the screw engaging worm nuts 50 in an appropriate direction of rotation through interconnecting couplings and connecting shafts illustrated in FIGS. 1 and 2. The screws are raised until terminal enlarged screw portions 90, see FIGS. 2 and 3, defining the lower screw end limits engage the lower peripheries of the stop collars 72. Such contacts place a load on the drive motor 14 which is effective to trip a motor overload control and deactuate the motor 14 with each of the load screws in the upper position as illustrated in FIG. 3.

However, in the event the lower peripheries of the stop collars 72 fixed to the threaded ends 76 of the casings 62 are not disposed in precisely the same horizontal plane, it is apparent that an excessive compression force will be exerted against the stop nut 72 and transmitted to the tubular casing portion 62L employed in conjunction with a jack member 10A and 10B which first has the enlarged screw portion 90 come in contact with its respective stop collar 72.

As a result of such a stopping contact, an excessive driving force will be imparted to that first-to-stop screw 42, the input drive shaft 30, gear nut 50 and supporting bearing components 52 and 58 of that jack construction which first fully retracts load screw 42 within its casing portions 62U and 62L.

In accordance with this invention each casing portion 62L has an annular segment 92, see FIG. 3, of reduced thickness which is adapted to collapse or axially compress upon a predetermined load being imparted to the stop collar 72 and connected lower casing portion 62L. Such tubing-collapsing load is insufficient to cause damage to the jack gear, screw, and bearing components but yet is of adequate magnitude to cause collapse of the annular safety segment 92 in the manner illustrated in FIG. 4. Although collapsed, segment 92 maintains an integral protective casing which does not interfere with subsequent normal jack operation.

Since the stop collars 72 will be out of adjustment in the horizontal plane, a maximum distance well within the permitted collapsing movement of the tubular casing 62L of each jack member, all four jacks will have the enlarged pin-supporting ends 90 come to a stopping engagement with the stop collars 72 before any damaging load is imparted to components of any one jack construction.

When all four stops collars are engaged by the enlargements 90 defining the lower end limits of the support screws, the drive motor 14 is deactuated by an overload control. Thus, there is no need for an attendant to follow the jack movements and manually deactuate motor 14 after a switch has been tripped to elevate the load screws of the connected jack members. In the illustrated system the load screws will automatically elevate the partially consumed anodes to the uppermost position for replacement by merely tripping a return switch for appropriate rotation of the actuating motor 14. The provided safety segment 92 disposed in each casing segment 62L assures the avoidance of any damage being imparted to an expensive jack component.

Rotation of the load screws 42 of the various illustrated jacks in the provided assembly of FIGS. 1 and 2 must be prevented so as to effect axial movement thereof by means such as guide pins 94, one of which is illustrated in FIG. 3. The pins may be mounted in a wall portion of tubular casing 62L of each jack assembly with the inner pin end riding in a slot disposed in the lower unthreaded portion 48 of each load screw 42. An alternative means for preventing rotation of each load screw 42 comprises guide channel means (not illustrated) which may slidably engage posed ends of anode support pin 40 illustrated in FIG. 3. It will be noted from the latter figure that pin 40 in addition to engaging enlarged screw end 90, engages spaced portions of a supported anode A, retaining washers 98 and cotter pins 100, the latter elements retaining the pin 40 in desired assembly with the supported anode.

The lower end limit of the support screw movement of the jack constructions illustrated in FIGS. 1 through 5 is determined by means of stop members 102 which are affixed to the upper end limits of the load screws 42 by means of a locking screw or pin such as pin 99 illustrated in FIG. 3. Since the support anodes are not normally disposed relative to the underlying cathodes with the load screws in fully extended positions, stops 102 do not normally come into play. However, a "fail safe" feature similar to segments 92 of reduced thickness in casing portions 62L may be employed in connection with the stop members 102 defining the extent of the load screw extension from casing portion 62L by rendering the stops 102 collapsible upon the exertion of a predetermined force thereon, or in an alternative method by making the upper surface portion of jack casing 64 readily collapsible so as to provide "give" sufficient to enable all four stops 102 to arrive at the end limits of their movement and avoid any excessive force being imparted to the elements of any one jack member.

While the jack systems of FIGS. 1 through 5 ralate to jack constructions in which load screws extend through a sealed opening in the course of axial movement relative to an underlying bath, the aforedescribed inventive concept is equally applicable to jack systems in which a rotating screw member axially drives a load-supporting traveling nut along the screw length. The traveling nut is prevented from rotating whereas the engaged screw rotates in place in bearings and is axially immoveable.

Figure 6:
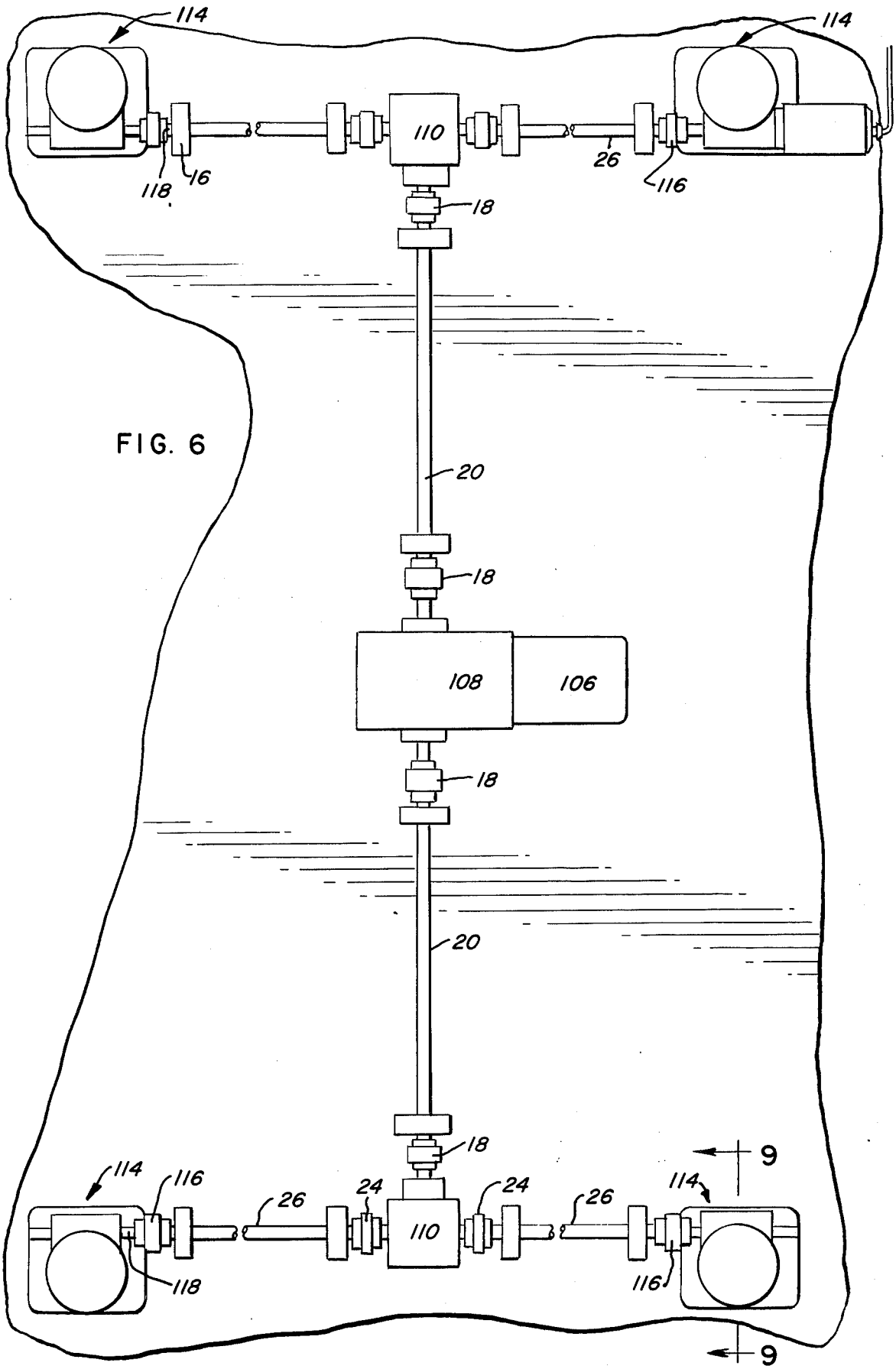
FIG. 6 is a top plan view illustrating a plurality of jack members driven by a single motive means employed for purposes of simultaneously elevating a platform member.

Thus FIG. 6 is illustrative of a jack system in which a motive means such as a motor 106 has the rotary output thereof reduced in speed by means of speed reducer 108. The speed reducer 108 rotatably drives gears in gear boxes 110 to which is connected by means of couplings 18 and drive shafts 20. Rotary movement from the gear boxes 110 is transmitted to rotatable load screws 112, see FIG. 7, of jack constructions 114 by means of couplings 24 and connecting shafts 26. Shafts 26 rotatably drive couplings 116 connected to input drive shafts 118 of the jacks 114.

Figure 9:
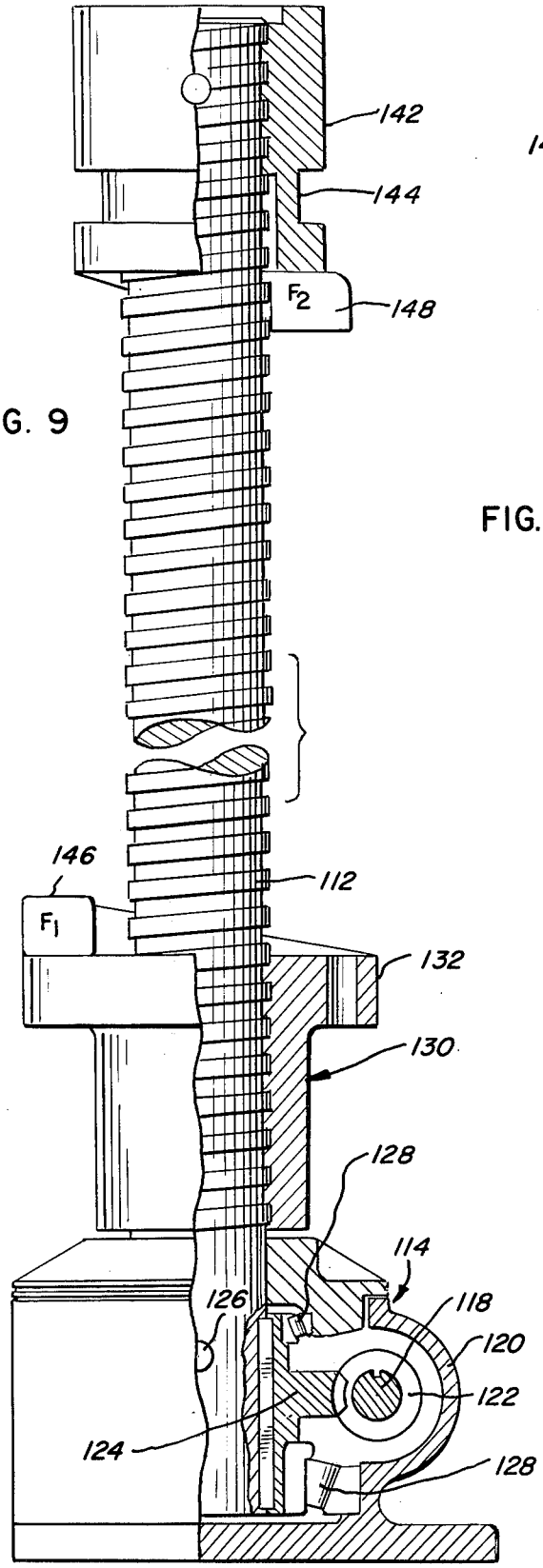
FIG. 9 is a fragmentary elevational view partly in section of a jack member employed in the jack assembly of FIGS. 6 to 8.

It will be more clearly noted from FIG. 9 that each input drive shaft 118 of each jack 114 is partially disposed within a jack casing 120 and has a worm portion 122 which engages worm gear nut 124 which is pinned as by means of pin 126 to the lower unthreaded portion of load screw 112. Nut 124 and engaged load screw 112 are rotatably mounted on roller bearings 128 disposed within jack casing 120. Mounted on each load screw 112 of each jack assembly 114 is a traveling load engaging nut 130 having an apertured flange portion 132 which is adapted to be secured to a corner of a platform or the like by means of bolts or equivalent attachment means.

Figure 8:
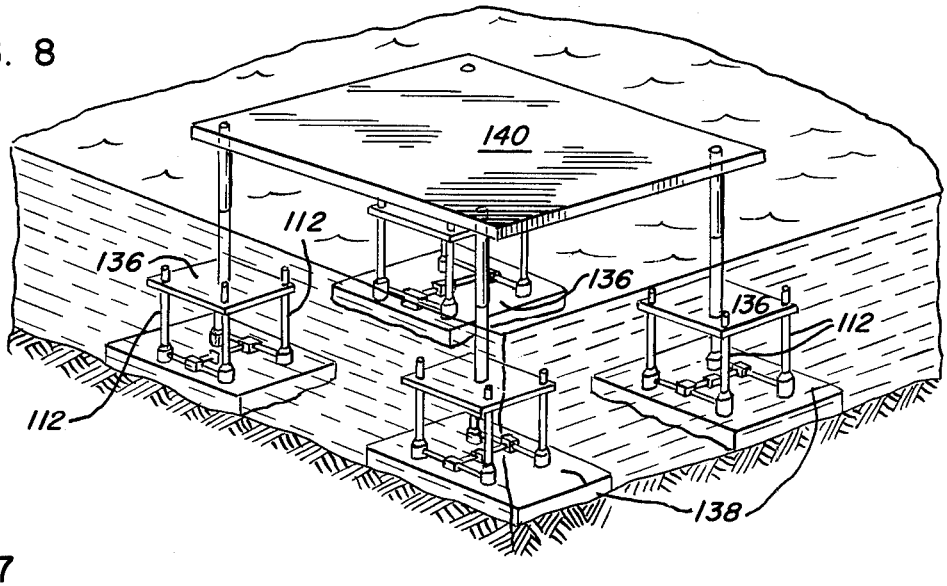
FIG. 8 is a schematic representation illustrating the manner whereby the jack assembly of FIG. 6 may be employed for purposes of supporting an off-shore drilling platform.

FIG. 8 is a schematic representation of the manner whereby four jack systems each of which comprises four jacks in an assemblage such as illustrated in FIG. 6 support underwater support platforms 136. Each series of four jacks is disposed upon a supporting "mud flat" 138 proposed on the sea bed and comprising a leveled surface adequate to support in a level condition the four jacks and associated driving means illustrated in FIG. 6. Each support platform 136 supports one corner of an overlying platform 140 for a drilling rig or the like which is disposed above the water level.

Thus in the normal course of use of the jack assemblages of FIG. 6, four jacks 14 are disposed on a mud flat 138 and the supporting platform 136 engaging traveling nuts 130 at each platform corner is elevated to a desired height. Fixed stops 142 are pinned or otherwise suitably affixed to the upper end portion of each load screw 112. It will be noted from FIGS. 9 and 10 that the central portion of each stop 142 is open so that the upper end of each load screw 112 may pass therethrough to facilitate locating thereof at a desired, precise position on the end of the load screw 112.

After each assemblage of four jacks and associated components is leveled on a mud flat 138 on the sea bed, the fixed stops 142 are predeterminately positioned on the upper end portions of the load screws 112 so as to lie in substantially the same horizontal plane. Thus, platforms 136 are simultaneously elevated by the motor 106 until the four corners of the supported platform 136 engage each of the stops 142.

Assuming however that the stops 142 are not all disposed at the same precise level, when the lowermost stop 142 is engaged, a fail safe band 144 comprising an annular wall portion of reduced thickness will fail upon exertion of a predetermined force exerted against such stop which rotates with the rotatable load screw 112. Such force is imparted by means of a platform-supporting traveling nut 130.

It will be most clearly seen from FIG. 9 that a rotary stop dog portion 146 is integrally formed with an upper surface portion of the traveling nut and is axially movable therewith along the length of each rotatable screw 112. Also, it will be noted that each rotatable stop 142 containing the fail safe annular band 144 has a similar rotatable stop dog or tooth portion 148. The stop 142 is pinned on the load screw 112 in a predetermined position so that when the traveling nut 130 reaches the upper end limit of its movement against stop 142 the face F1 of the traveling nut rotary stop dog portion 146 will engage face F2 of the rotary stop dog portion 148 of the stop 142.

Figure 7:
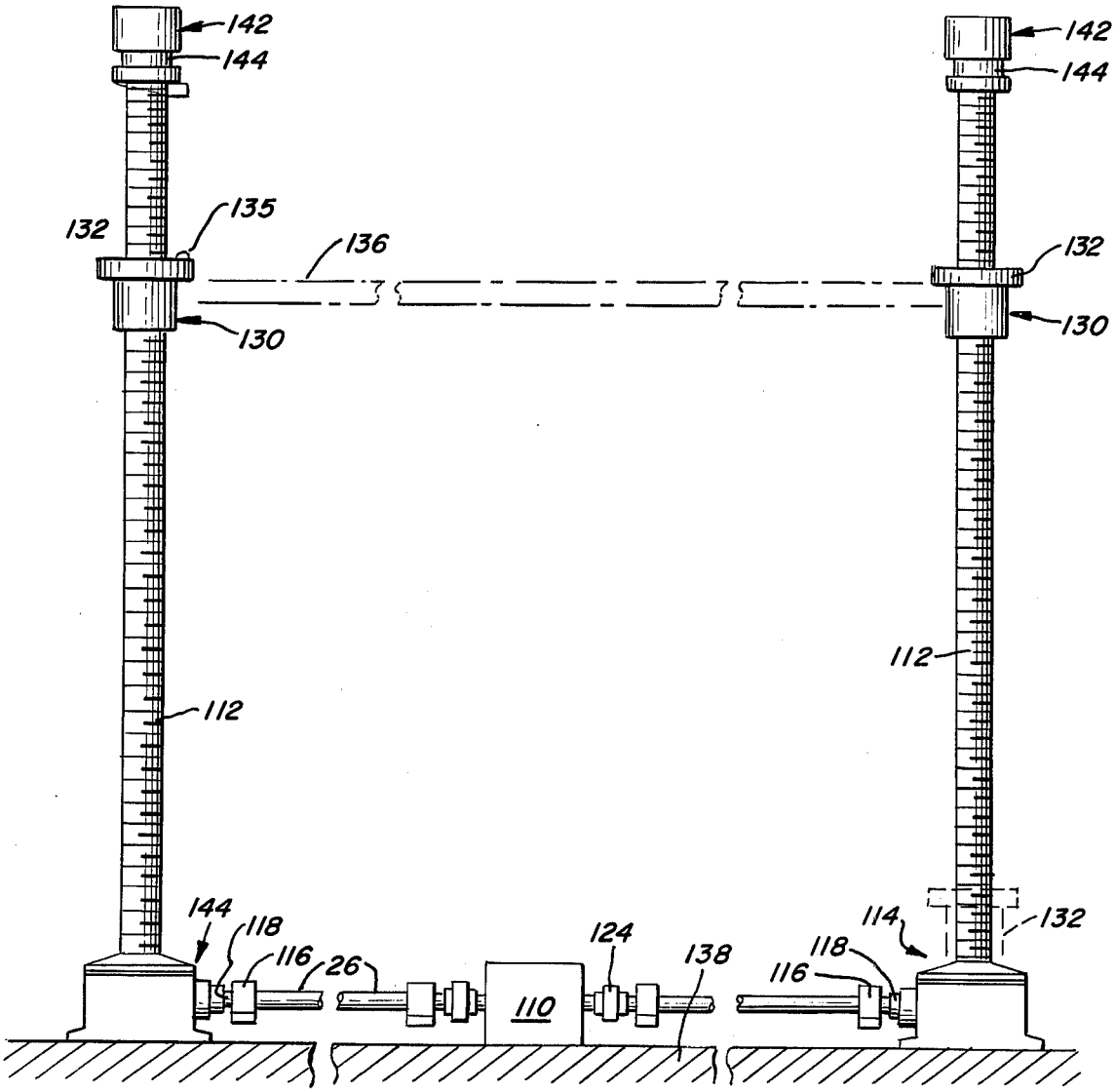
FIG. 7 is a fragmentary side elevational view of jack members illustrated in FIG. 6.

Thus, when the motive means 106 of FIG. 6 which may comprise a motor or equivalent motive means, actuates the load screws 112 of the four jacks of the provided system illustrated in FIG. 6, the four traveling nuts 130 lift supporting platform 136 by means of bolts 135 or the like, see FIG. 7, and elevate the support platform as a unit until the four traveling nuts engage the four stops 142 in the manner above described.

In the event one of the stops 142 is engaged before the remaining three stops are engaged by their respective traveling nuts 130, excessive force is applied to the first-reached stop nut 142. Since face F1 of the stop dog portion 146 of the traveling nut 132 will engage the face F2 of the stop dog portion 148 of the fixed stop 142, a combined axial and twisting force will collapse the fail safe annulus 144 of the stop 142 so as to axially move lower flange portion 150 of the stop 142 as the same is compressed and twisted into the collapsed condition illustrated in FIG. 10.

Figure 10:
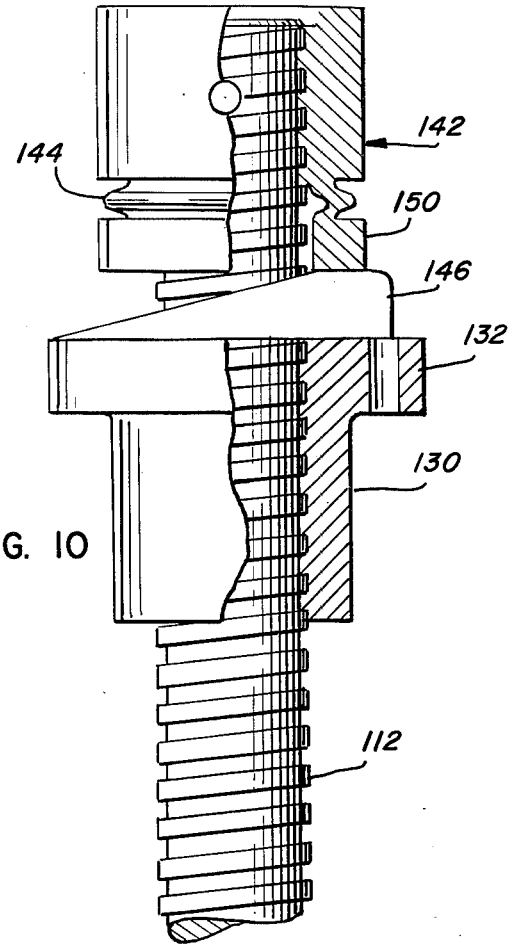
FIG. 10 is a fragmentary elevational view partly in section illustrating the condition of a safety stop element after an axial force adequate to collapse such stop has been exerted thereagainst.

Since the stops 142 are all disposed at precisely the same horizontal level, the distance of collapse of the segments 144 as measured along the axis of the load screw 112 illustrated in FIG. 10 will be adequate to enable all of the traveling nuts 130 at the remaining three corners of the supported platform 136 to come into engagement with the respective rotary stops 142 thereby placing a load on the motor 106 which trips an overload control whereby de-energizing the motor. The factors of safety built into the gears, nuts, bearings and screws of the above-described jacks are such that the loads imparted to any individual jack member are never sufficient to damage any of such jack components even when a fail safe device is encountered. The fail safe stops above described are adapted to fail at 200% of the normal maximum load to be supported by the load screws. The factors of safety for each jack component should be much higher to prevent any possibility of damage. Also, since the jacks and associated components are located under water appropriate sealing techniques are employed to maintain the jack, motor and gear casings water tight. Exposed jack components such as screws 112 may be of water-resistant material or coated with a protective paint, grease or the like.

It is seen from the foregoing, therefore, that jack constructions have been provided which possess fail safe features adapted to prevent damage to driving mechanisms employed in jack constructions. The novel fail safe feature is provided to enable a single motor means to simultaneously actuate a plurality of jack members moving to stop positions without danger of jack-damaging overload being imparted to any single jack member. The provided fail safe feature may be incorporated in jack constructions of known design which are already in the field with a minimum of expense. The provided fail safe features may be incorporated with known jack constructions by the addition of collapsible safety structures which are relatively modest in cost, being inexpensive to both manufacture and install.

Although the foregoing description has been specific with respect to worm gear jacks, it is apparent that the fail safe features described may be employed to advantage with any jack construction having mechanical components intended to be protected against overload and resulting damage.

It has also been seen from the foregoing description that a specific jack embodiment has been provided in which a load screw adapted to extend from a protective tubular housing may utilize as a stop, a novel adjustable collar having a unique seal and packing gland construction incorporated therewith. Such seal is both efficient in operation and simple in details of construction.

In view of the many obvious structural modifications which may be made of the invention features above discussed in detail, it is intended that this invention be limited only by the scope of the appended claims.

I claim:

1. In a supporting jack construction the combination comprising drive means, mating driven means adapted to be reciprocally moved by said drive means along a predetermined path, stop means disposed adjacent an end limit of said predetermined path adapted to resist axial movement of said driven means by collapsing upon exertion of a predetermined collapsing force thereagainst; such collapsing force being inadequate to result in damage to said drive means and driven means at the point of the mating relation.

2. The jack construction of claim 1 in which said driven means comprises a nonrotatable load screw mating with a rotating drive gear comprising the drive means; said load screw being axially reciprocally moved.

3. The jack construction of claim 1 in which said drive means comprises a rotating load screw engaging a nonrotating nut member comprising the driven means movable along the axis of said load screw during rotation thereof.

4. The jack construction of claim 3 in which said load screw is fixed to a worm gear nut and a rotatable input shaft rotatably drives said worm gear nut.

5. In a jack system, an elongated supporting means reciprocally movable along the longitudinal axis thereof, protective covering means for said supporting means having a sealed opening disposed at one end thereof whereby said supporting means disposed therein may extend therethrough in sealed relation with said covering means; an adjustable stop means supported by and adjustably movable relative to said covering means one end and adapted to limit movement of the supporting means into said protective covering means; said supporting means exerting an axial thrust against the stop means and connected covering means when said stop means functions to limit the movement of said supporting means into said protective covering means; a zone of reduced thickness disposed in said supporting means whereby the same may collapse upon the exertion of an axial thrust of predetermined magnitude against said stop means by said supporting means.

6. The jack system of claim 5 in which sealing means is disposed against the lower end limit of said supporting means and maintained in position in the interval between the stop means and supporting means to define said sealed opening, by gland means adjustably supported on the inner periphery of said stop means.

7. The jack system of claim 5 in which said supporting means comprises a nonrotating load screw having a threaded portion spaced from said sealed opening, and a driving worm gear nut meshing with said threaded portion effects reciprocal movement thereof; the load screw portion moving in said sealed opening having a smooth, uniform outer periphery.

8. A jack system in which a plurality of jack systems as set forth in claim 5 are arranged in series and a single motive means reciprocally moves said supporting means thereof simultaneously through interconnecting means.

9. In a jack system a reciprocally movable elongate supporting means adapted to position a supported article in precise positions corresponding to positions of said supporting means assumed in the course of its reciprocal movement; said supporting means having a first portion to be protected from the ambient atmosphere; protective covering means covering said first portion and having a sealed opening through which a second portion of said supporting means may pass in the course of reciprocal movement thereof; such article to be supported being attached to said supporting means second portion exteriorly of said protective covering; adjustable stop means mounted on and adjustably positionable relative to the end of said protective covering means adjacent said sealed opening and adapted to engage an end portion of said supporting means when said supporting means is retracted into said protective covering into its innermost position; packing disposed in the interval between the end of said supporting means and said stop means and defining said sealed opening; and gland means supported by and adjustably positionable along the length of the inner periphery of said stop means for urging said packing into said interval.

10. In a jack system a reciprocally movable support rod having a threaded portion for engagement with a driving gear, said rod having an elongate unthreaded portion with a distal object-supporting end; protective means covering threaded portions of said rod and having a sealed opening disposed at a distal end through which an unthreaded portion of said rod extends; said distal end of said protective means being threaded about its outer periphery, a stop collar threadably engaging said distal end being adjustably positionable along the length thereof and adapted to engage an end portion of said support rod when retracted into said tubular means; the inner periphery of said stop collar being threaded; a packing gland threadably engageable along the length of the stop collar inner periphery whereby packing may be disposed against the end limit of said protective means and wedged in fluid-sealing engagement in the interval between the end limit of said protective means and the adjacent outer periphery of said support rod; the position of said stop sleeve on said tubular means determining the distance said support rod may be retracted into said tubular means.

11. In a jack system, a reciprocally movable support rod; means for reciprocally moving said support rod connected thereto; protective tubular means encompassing a portion of said support rod to be protected from the ambient atmosphere and having an opening disposed at an end thereof through which a portion of said support rod may extend whereby said support rod is extended from and retracted into said tubular means; said means for moving said support rod exerting an axial thrust against said end of said tubular means when such rod is retracted inwardly within the protective tubular means; said tubular means having a peripheral area of reduced thickness whereby said means may be axially compressed in the area of said reduced thickness area upon exertion thereagainst of an axial thrust of predetermined magnitude.

12. In combination, a motive means, a plurality of jacks; each of said jacks having an axially movable support means driven along a predetermined path by said motive means; the predetermined paths traversed by said support means being substantially equal in length; stop means engaging said support means at the end limits of their predetermined paths; control means de-energizing said motive means after all of said support means have engaged said stop means; at least a portion of each of said stop means being resistingly movable along the predetermined path in which disposed by its respective support means until all of said support means have engaged said stop means.

13. In a supporting jack construction, the combination comprising support means reciprocally movable along a predetermined path, motive means connected to said support means for driving said support means along said predetermined path; stop means defining one end limit of said predetermined path; said stop means being deformable when engaged by said support means so as to permit additional movement by said support means along said predetermined path beyond said one end limit; and means for deactivating said motive means after a predetermined resistance is encountered thereby.

14. The jack construction of claim 13 in which said support means comprises a nonrotating traveling nut movable along the length of a rotating, supporting load screw; said stop means being fixed in a predetermined position along the length of said screw in the path of said traveling nut; said nut and stop means having stop dogs affixed thereto adapted to mutually engage when said nut reaches the end of its predetermined path, said nut stop dog exerting a twisting compressive force on said stop means stop dog when driven into engagement therewith by said motive means.

* * * * *